US009318239B2

(12) United States Patent
Sovel et al.

(10) Patent No.: US 9,318,239 B2
(45) Date of Patent: Apr. 19, 2016

(54) CORROSION RESISTANT, ENVIRONMENTALLY SEALING, ELECTRICALLY CONDUCTING, CABLE CONNECTOR

(71) Applicants: James E. Sovel, Panama City Beach, FL (US); Jacob Cornman, Panama City Beach, FL (US); Meir Gershenson, Panama City Beach, FL (US)

(72) Inventors: James E. Sovel, Panama City Beach, FL (US); Jacob Cornman, Panama City Beach, FL (US); Meir Gershenson, Panama City Beach, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 113 days.

(21) Appl. No.: 13/895,737

(22) Filed: May 16, 2013

(65) Prior Publication Data

US 2014/0338967 A1 Nov. 20, 2014

(51) Int. Cl.
*H01B 7/28* (2006.01)
*B63G 7/04* (2006.01)

(52) U.S. Cl.
CPC ..... *H01B 7/2806* (2013.01); *B63G 7/04* (2013.01)

(58) Field of Classification Search
CPC ..... H01B 7/2806; B63G 7/04
USPC ..... 174/70 R, 70 A
See application file for complete search history.

(56) References Cited

U.S. PATENT DOCUMENTS

| | | | | |
|---|---|---|---|---|
| 3,197,730 | A * | 7/1965 | Hargett | 439/606 |
| 3,479,445 | A * | 11/1969 | Jack | 174/94 R |
| 4,257,658 | A * | 3/1981 | Hammond et al. | 439/98 |
| 5,286,921 | A * | 2/1994 | Fontaine et al. | 174/84 R |
| 5,312,271 | A * | 5/1994 | Matsumoto et al. | 439/578 |
| 5,527,191 | A * | 6/1996 | Bevis et al. | 439/801 |
| 7,588,460 | B2 * | 9/2009 | Malloy et al. | 439/578 |
| 2012/0080419 | A1 * | 4/2012 | Bush et al. | 219/385 |

FOREIGN PATENT DOCUMENTS

DE 3433464 * 3/1986

* cited by examiner

*Primary Examiner* — Timothy Thompson
*Assistant Examiner* — Charles Pizzuto
(74) *Attorney, Agent, or Firm* — James T. Shepherd

(57) ABSTRACT

A connector anchors as outer conductor onto a cable and connects the outer conductor to the cable's inner conductor without exposing the inner conductor to the ambient environment. The connector includes a longitudinally split cylinder having a thicker center wall and a pair of flanking walls that wrap around a notched section of the cable and contact the inner conductor. An inner ring with multiple recessed interior circumferential grooves wraps around and overlaps the split cylinder so that the grooves will emboss and grip the cable's jacket without piercing the jacket when swaged. The outer conductor is placed over the inner ring. An outer ring anchors the outer conductor to the inner ring when swaged.

20 Claims, 4 Drawing Sheets

CORROSION RESISTANT, ENVIRONMENTALLY SEALING, ELECTRICALLY CONDUCTING, CABLE CONNECTOR

STATEMENT OF GOVERNMENT INTEREST

The invention described herein may be manufactured and used by or for the Government of the United States of America for Governmental purposes without the payment of any royalties.

FIELD OF THE INVENTION

The present invention relates generally to a swaged-on connector, and, in particular, to a conductive connector for electrically tapping an inner conductor of a mine sweeping cable to provide an electrical connection to an outer conductor, and simultaneously coaxially anchoring the outer conductor to the cable.

BACKGROUND OF THE INVENTION

Magnetic influence minesweeping cables create magnetic fields in the areas around the cables in order to cause magnetic influence mines deployed in a marine environment to explode prematurely, i.e., without damaging a ship. The magnetic field is typically created by a pair of exposed oppositely-charged conductors—a forward electrode and an aft electrode—that comprise parts of a cable being towed behind a minesweeping vessel. The cable typically also includes a continuous length inner conductor that is sealed from the corrosive saltwater environment, typically by a cable jacket wrapped around the cable. In one configuration, the insulated inner conductor provides electricity to the exposed aft electrode. Thus, a need has been recognized in the art to anchor an external conduct or to an environmentally-sealed, jacketed, coaxial cable without breaking the integrity of the jacket, while at the same time providing an electrical connection between an internal conductor in the cable and the external conductor.

SUMMARY OF THE INVENTION

The invention provides a compact, corrosion resistant, environmentally sealing, conductive connector for creating a water tight electrical connection between an inner conductor of a coaxial cable and an outer conductor, where the outer conductor is overlaying a peripheral section of the coaxial cable. The inner conductor and the outer conductor can be two dissimilar metals, each used for its unique properties while their negative properties are avoided. For example, aluminum is an excellent conductor and lightweight, but corrodes easily so it is kept sealed in the cable by the sealing action of the connector. Titanium has excellent resistance to corrosion, but it has low conductivity so it can only be used efficiently by keeping conductive lengths to a minimum.

The cable is insulated by a jacket, where the jacket can be composed of an insulating material such as polytetrafluoroethylene (PTFE) that is known to be very difficult to attach to, in part because it has a very low coefficient of friction. A common, well-known use of PTFE is in Teflon™, a DuPont product which is idiomatic as being a material to which nothing sticks. The invented connector enables conduction of a high electrical current between an inner conductor and an outer conductor of the cable, while maintaining a hermetic seal and structural integrity of the cable.

In an exemplary application, the connector is a fitting on a magnetic minesweeping cable developed by the United States Navy. The connector attaches the outer conductor to the cable, and provides an electrical path between the attached outer conductor and the electrically tapped inner conductor. The application requires a connector that provides a water tight seal, which is corrosion-resistant in a seawater or salt water environment, where the outer conductor comprises an electrode composed of a metallic material that is different than the inner conductor.

The connection mast remain water tight even if submerged in several hundred feet of seawater. In many applications, the cables will be stored on a winch, and the cable can be quite hot if wraps are left wound on the winch during a mine sweep. In the exemplary application, the cable can be stored outdoors before being deployed, and therefore the connector must perform under cold weather conditions as well as high temperature conditions. The cable fitted with the invented connector must also be able to handle large temperature variances such as when being shipped via air where temperatures can be below freezing, and in shipping containers in the sun that can reach in excess of 160° F.

In an exemplary embodiment of the invention, the connector includes a pair of intermediate halves of a longitudinally split open-ended cylinder, where the split open-ended cylinder has a split-cylinder length. Each intermediate half has a semi-cylindrical wall with a thicker center wall having a center length and a smaller center diameter. The thicker center wall has adjacent a pair of flanking walls, where the pair of flanking walls bookend the center wall, and each flanking wall has a flanking wall length and a flanking wall diameter. Each flanking wall diameter is greater than the diameter of the center wall, such that the flanking walls are thinner than the center wall. The pair of intermediate halves are assembled on a notched cable as the split open-ended cylinder, wherein the split open-ended cylinder is simultaneously electrically contacting two or more exposed layers of the inner conductor of the cable.

In an exemplary variation illustrated herein, the cable's inner conductor has three conductive layers. The cable jacket and each of the inner conductive layers are coaxial. The cable is prepared to establish electrical contact at a specific location on the cable. The preparation includes removing a sectional length of the cable jacket, where the sectional length is about the length of the split-cylinder length, and its removal exposes an outermost layer of the inner conductor. In a subsequent step a shorter sectional length of a center portion of the outermost layer is removed, thereby exposing a middle layer of the inner conductor, and leaving a pair of flanking sectional lengths of the exposed outermost layer. The cable preparation steps of removing the sectional length of the jacket and the shorter sectional length of the center portion of the outermost layer, circumferentially notches the cable; therein providing an electrical contact point and a mechanical stronghold on the cable.

In another subsequent step, an electrical joint compound can be applied to the exposed layers of the inner conductor and the conductors after they are manually abraded with a wire brush. The electrical joint compound in combination with abrasion generally is selected to reduce electrical resistance as the abrasion and joint compound break up and dissolves any oxides formed on the inner conductor. It also provides protection for the connection against the harmful effects of the environment.

The pair of intermediate halves is assembled in the notch, such that the center wall contacts the middle layer, the flanking walls contact the flanking sectional lengths of the exposed outermost layer. The trimmed ends of the cable jacket are substantially flush with the ends of the assembled intermediate halves. The assembly produces an electrical contact and the intersecting intermediate halves are seated in the notch of the cable, and therefore the assembled split cylinder also provides mechanical resistance to translational movement at the mechanical position. Also, the harder material of the intermediate halves relative to the inner conductors and its ability to be plated, help create a better electrical connection during the swaging process.

The cable has a core strength member, and therefore the cable jacket and the inner conductor can be trimmed without substantially reducing the strength of the cable, as the strength member provides tensile strength to the cable.

The invented conductive connector also includes an inner ring with a larger inside diameter, and a longer length than the pair of intermediate halves. The inner ring functionally bridges the notch in the cable, and is swaged onto the cable and intermediate halves, thereby providing a mechanical attachment with the jacket and an electrical connection with the pair of intermediate halves. The inner ring is an open-ended cylinder with recessed inside circumferential grooves that are proximate to the open ends of the inner ring. The inner ring has an inside diameter that is sufficiently large to allow the inner ring to slide over the cable and the split open ended cylinder. The inner ring can be swaged onto the cable jacket without affecting the integrity of the jacket. The swaged on inner ring provides a corrosion resistant seal that is substantially anchored to the cable, restraining both translational movement and rotational movement. The swaging causes the recessed circumferential grooves to emboss the jacket. Swaging is complete when the inner ring reaches a roundness within tolerance limits that produce a water tight seal, where the seal is good even at several hundred feet. The embossed jacket substantially forms an interference fit with the recessed inside circumferential grooves. Preferably, the depths of the grooves are less than the thickness of the jacket so that the embossing does not pierce the jacket when swaged. The circumferential grooves can be selected to mechanically seal against various kinds of cable jacket materials other than PTFE. Other materials include PVC, FVDC, EPDN, Santoprene™—a product of Monsanto, Pylon™ and Neoprene™—both, products of DuPont, polyesters, acrylics, and other polymeric materials. The swaging also presses the pair of intermediate halves against the inner conductor, therein forming an excellent conductive contact and frictional resistance between the cable's inner conductors and the walls of the intermediate halves. The outermost layer of the inner conductor abuts the center wall.

The invention also includes an outer ring, which is an open-ended cylinder with a length that is similar to the split cylinder length of the pair of intermediate halves. The outer ring has an inside diameter chat is large enough to slide over the inner ring and outer conductor. The outer conductor is distributed around the inner ring, substantially overlaying most of the inner ring. The outer ring is slid over the outer conductor and substantially centered on the inner ring. The outer ring is then swaged-on locking the outer conductor between the inside of the outer ring and the outside of the inner ring.

BRIEF DESCRIPTION OF THE DRAWINGS

The foregoing invention will become readily apparent by referring to the following detailed description and the appended drawings in which.

DETAILED DESCRIPTION OF THE INVENTION

Figure 3:
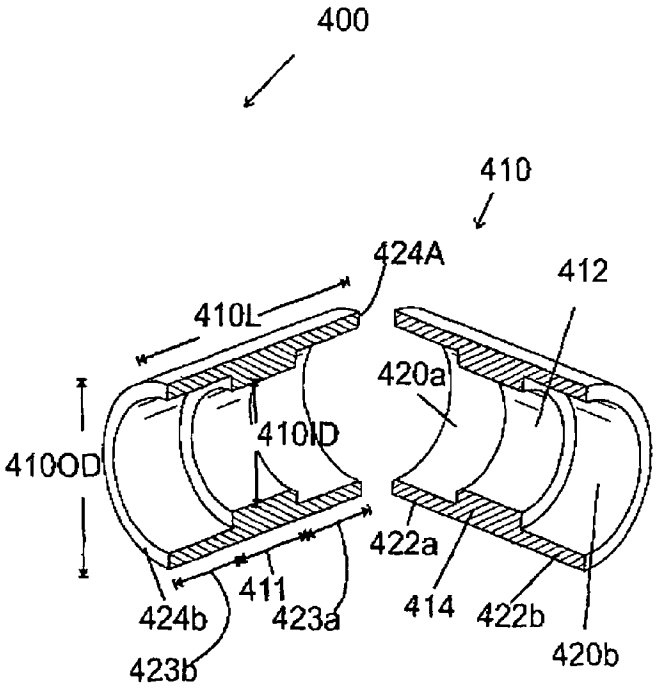
FIG. 3 is a perspective view of a conducting pair of intermediate halves that are to be assembled into a notch cut into the cable, wherein the cylinder formed by the intermediate halves has a thicker center wall and the cylinder is in electrical contact with exposed stepped layers of the inner conductor.
Figure 6:
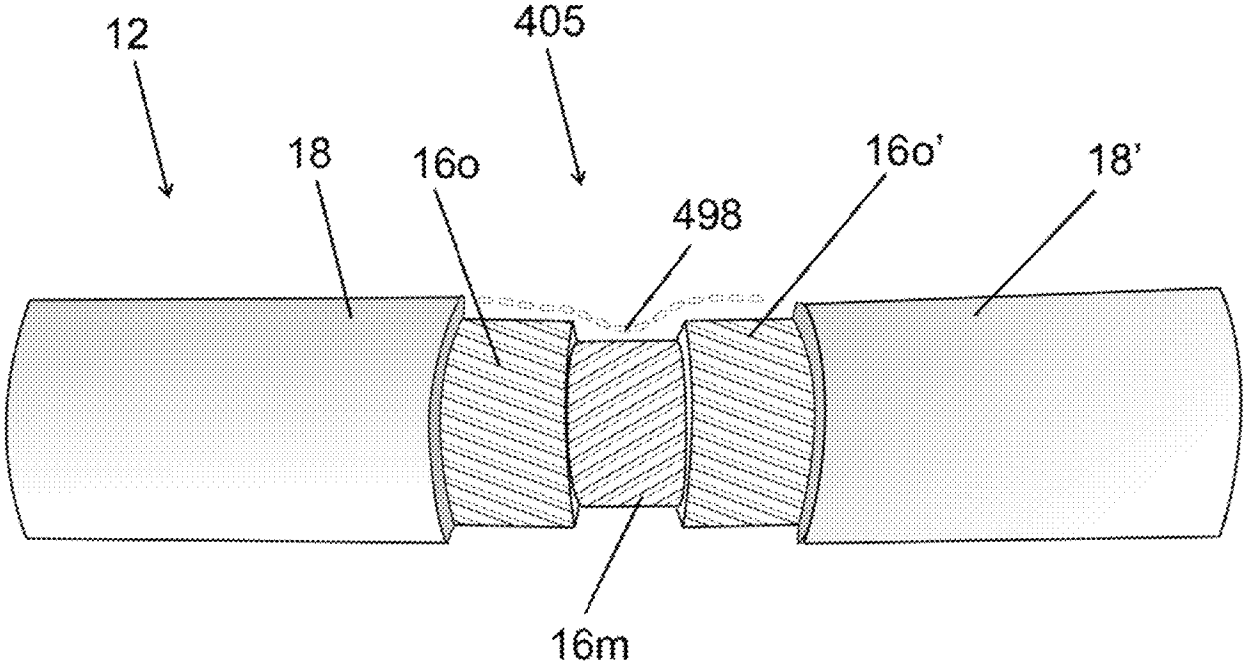
FIG. 6 is a perspective partial view of a cable prepared to receive the connector, where the cable is notched, exposing layers of the inner conductor.

The illustrated invention is a conductive connector 400. As shown in FIG. 3, the conductive connector 400 includes a pair of intermediate halves 410 of a longitudinally split open-ended cylinder having a split-cylinder length 410L, and a split-cylinder outside diameter 410OD. Each intermediate half has a semi-cylindrical wall with a thicker center wall 412 having a center wall thickness 414, a center smaller inside diameter 410ID, and a center wall length 411. The center wall 412 has a pair of flanking walls 420*a*,420*b* where the pair of flanking walls 420*a*,420*b* bookend the center wall 412. Each flanking wall has a length 423*a*,423*b* and a thickness 422*a*, 422*b*; where the flanking wall thicknesses 422*a*,422*b* are thinner than the thickness 414 of the center wall 412, such that the flanking walls 420*a*,420*b* are thinner than the center wall 412. The pair of intermediate halves is designed to simultaneously electrically tap two or more of the exposed layers of the inner conductor of the cable. Exposed layers 16*o*,16*o*', 16*m* are illustrated in FIG. 6.

The intermediate halves are composed of a conductive metallic material. A suitable metal is a bard aluminum, and to reduce galvanic corrosion the intermediate halves are plated in tin.

Figure 1:
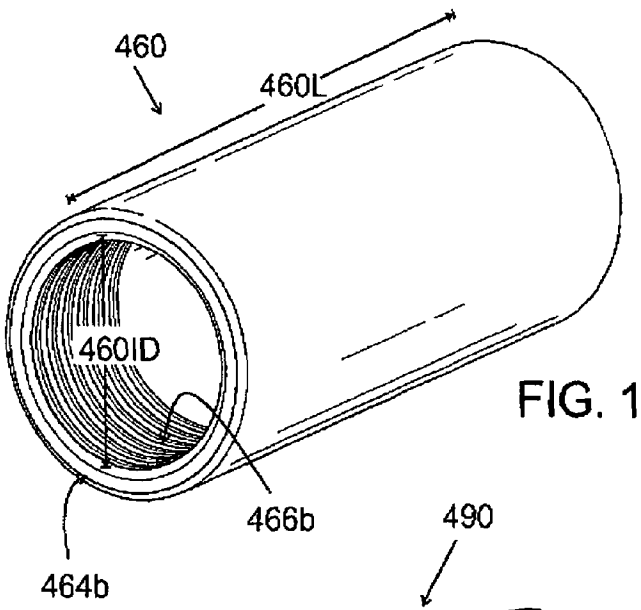
FIG. 1 is a perspective view of an inner ring of a swaged-on, corrosion resistant, sealing, tension carrying connector.
Figure 4:
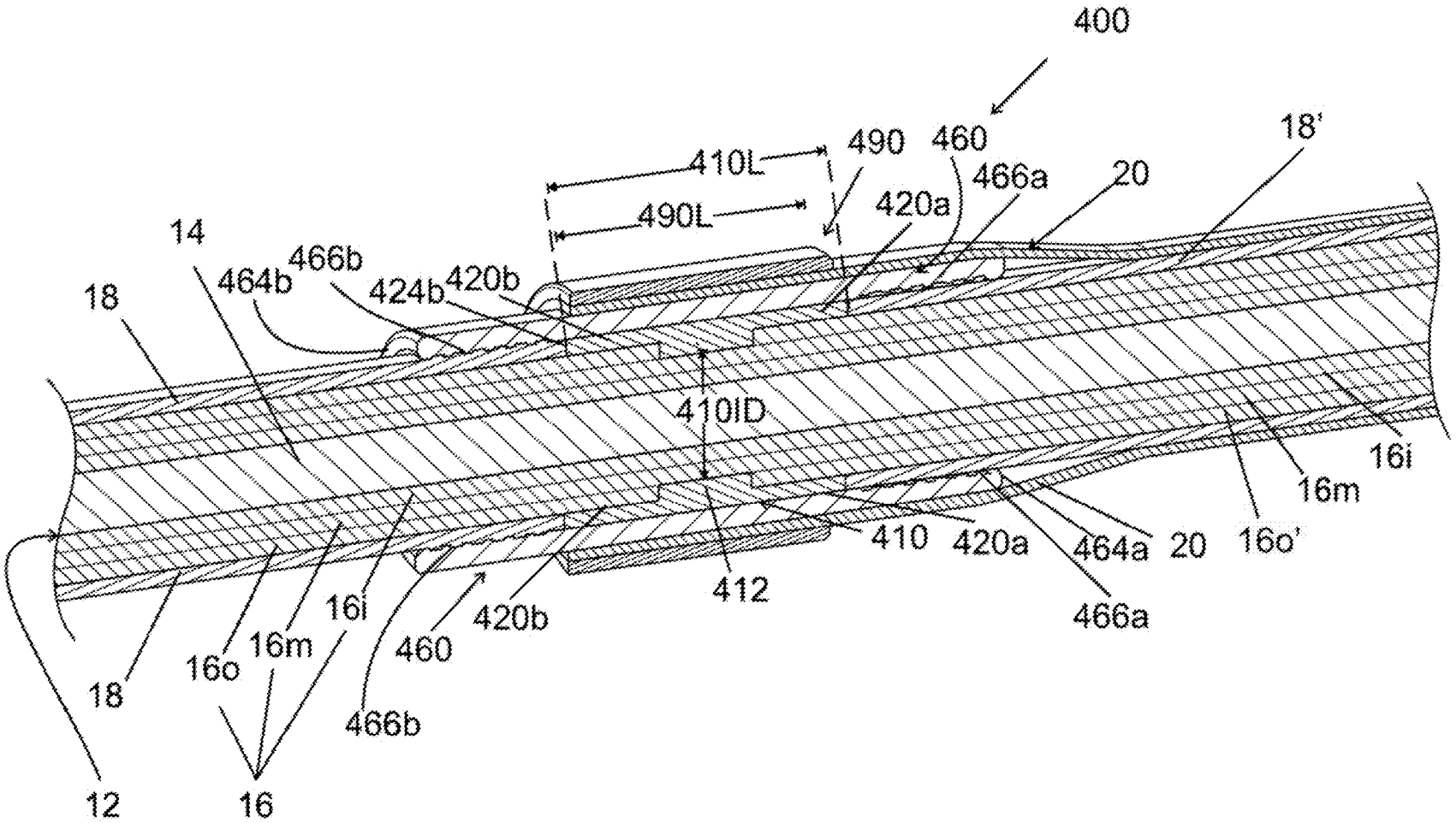
FIG. 4 is a substantially longitudinal cross-sectional partial view of a minesweeping cable fitted with the illustrated connector.

The conductive connector 400 also includes an inner ring 460 as illustrated in FIG. 1, The inner ring 460 is substantially a cylinder with a pair of open ends 464*a*,464*b* (see FIG. 4 to see both open ends 464*a*,464*b*). Each open end has a plurality of recessed inside circumferential grooves 466*a*,466*b* (see FIG. 4 to see both grooves 466*a*,466*b*) that are proximate to the open ends of the inner ring 460. The inner ring has an inside diameter 4601D that is larger than the outside diameter 410OD of the intermediate halves. The inner ring has a length 460L that is longer than the intermediate halves length 410L, such that the plurality of recessed inside circumferential grooves 466*a*,466*b* will extend beyond the intermediate halves 410 and overlay the cable jacket 18 when the inner ring is placed over the intermediate halves as shown in FIG. 4. The inner ring 460 is composed of a corrosion resistant metallic material. Preferably, the inner ring 460 is substantially composed of titanium plated with platinum.

The inner ring 460 is swaged on after being centered on the intermediate halves 460, which are first placed over the exposed layers 16*o*,16*o*' of the inner conductor 16. The swaging embosses the grooves into the jacket 18, providing a watertight, corrosion resistant seal with good resistance to rotational movement and excellent resistance to translational movement. Note that the depths of the grooves 466*a*, 466*b* are selected so that the jacket 18 isn't pierced during or after the swaging process. Typically, this means that the depths of the grooves are less than the thickness of the jacket. Before swaging, an electrical joint compound 498 (see FIG. 6) can be applied to the inner conductors layers 16*o*,16*o*',16*m*, and the inner conductor layers can be abraded as well. The abrasion and electrical joint compound facilitates electrical conduction between the inner conductor's exposed conductive layers 16*o*, 16*o*',16*m* and the walls 420*a*,420*b*,412 of the pair of intermediate halves 410.

Figure 2:
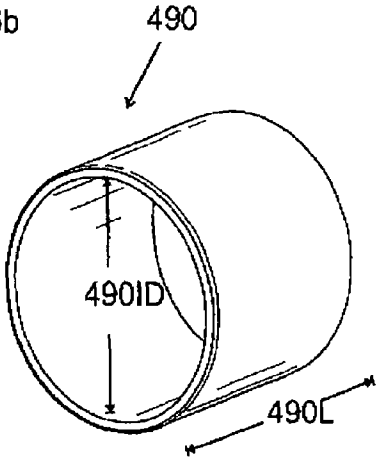
FIG. 2 is a perspective view of a corrosion resistant outer ring that is to be swaged onto the inner ring, securing the underlying outer conductor to the inner ring.
Figure 5:
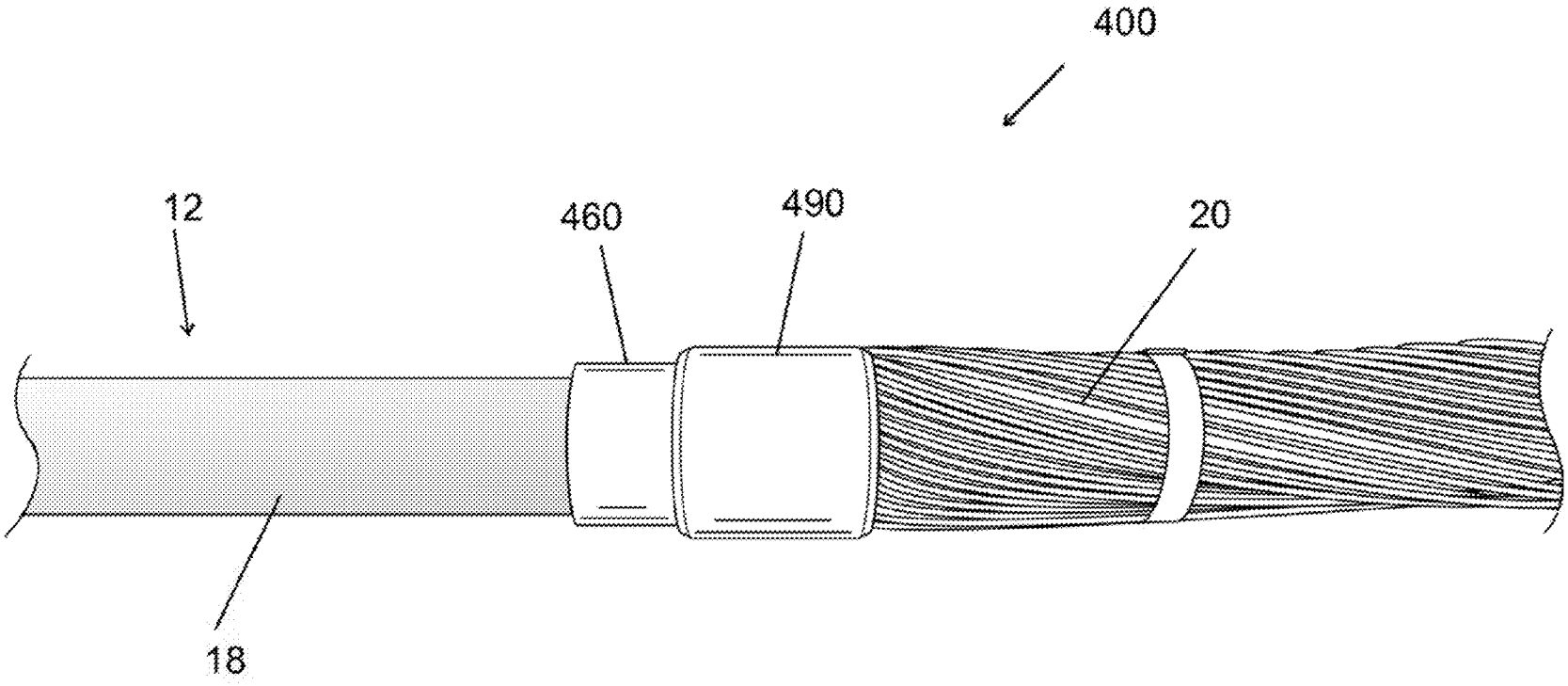
FIG. 5 is a perspective view of the connector installed on a minesweeping cable.

As illustrated in FIG. 2, the conductive connector 400 also includes an outer ring 490, which is an open-ended cylinder with a length 490L. The outer ring length 490L is similar to the split-cylinder length 410L of the pair of intermediate halves 410. The outer ring 490 has an inside diameter 490ID that is large enough to slide over the cable, the inner ring 460, and the outer conductor 20 (as shown in FIG. 4 and FIG. 5). The outer conductor 20 is distributed around the inner ring 460, substantially overlaying most of the inner ring.

The outer ring 490 is substantially composed of a corrosion resistant metallic material, wherein a suitable material is substantially titanium.

The outer ring is slid over the outer conductor 20 and centered over the previously swaged inner ring 460. The outer ring is then swaged on, anchoring the outer conductor 20 between the outer ring 490 and the inner ring 460.

In FIG. 4, the conductive connector 400 is attached to an S-cable 12 of a magnetic influence minesweeping system. S-cable 12 has a strength member 14, and a jacket labeled 18 and 18', to indicate that the jacket has had a sectional length removed. The jacket is typically composed of PTFE. The inner conductor 16 has three layers of aluminum wire, the innermost layer 16*i*, the middle layer 16*m*, and the outermost layer 16*o*, Note that the use of three layers in the illustrated example is exemplary only, and that other cables can have more than three layers of aluminum wire without departing from the scope the invention. Only the outermost layer 16*o* is circumferentially notched, thereby exposing the underlying middle layer 16*m* and leaving a pair of flanking sectional lengths of the exposed outermost layer 16*o*,16*o*', FIG. 6 shows the cable prepared to be fitted with the pair of intermediate halves 410.

The removal of sectional lengths of the cable jacket and the outermost layer of the inner conductor to establish electrical contact at a specific location on the cable does not prevent conduction along the outermost layer of the inner conductor. The intermediate halves, which are composed of a conductive metallic material, connect outermost layer 16*o* to outermost layer 16*o*' when the connector 400 is installed. Similarly, the section of cable jacket between 18 and 18' is bridged by the inner ring.

As mentioned previously, an electrical joint compound 498 can be applied to the exposed layers of the inner conductor, and the exposed layer can be abraded as required. The electrical joint compound 498, as shown diagrammatically in FIG. 6, reduces electrical resistance as it dissolves the oxide on connectors. The nature of the oxide removal is not harmful. The compound creates a light surface etch with no deep, localized attack. It only attacks the oxide. It also provides protection for the connection against the harmful effects of the environment.

The pair of intermediate halves 410 is assembled in the notch of the S-cable 12, such that the center wall 412 contacts the middle layer 16*m*, the flanking walls 420*a*,420*b* contact the exposed uppermost layer 16*o*, 16*o*', and the trimmed ends of the cable jacket 18,18' are substantially flush with the ends 424*a*,424*b* of the assembled intermediate halves.

The completed assembly of the pair of intermediate halves 410 provides electrical contact between the intermediate halves and the inner conductor 16. The ends of the flanging walls 420*a*, 420*b* are pressed in the notch by the swaging until the assembly abuts the elements defined by the notch 405 (see FIG. 6) in the S-cable 12. The notch therefore also provides an interference fit which holds the connector in place on the cable.

The cable has a core strength member 14, so the cable jacket 18 and the inner conductor 16 can be trimmed without substantially reducing the strength of the cable, as the strength member 14 is not touched, and the strength member provides most of the tensile strength to the cable 12.

The swaged on inner ring 460 is illustrated in FIG. 4. It is physically bridging the notch in the cable, where the notch is filled by the intermediate halves 410. The swaging provides mechanical attachment of the inner ring 460 with the jacket 18 and an electrical connection to the pair of intermediate halves 410. In this view the reader can see that the jacket 18 is embossed, and substantially forms an interference fit with the recessed inside circumferential grooves 466*a*, 466*b*.

The outer ring 490 is also swaged on. The outer conductor 20, which in the exemplary application is an external electrode of a minesweeping cable, is composed of a layer of a titanium clad copper conductor wire. The outer conductor 20 is distributed around the inner ring 460, substantially overlaying most of the inner ring. The outer ring 490 is slid over outer conductor 20 and aligned with the intermediate halves 410. The outer ring 490 is swaged on, thereby locking the outer conductor 20 between the inside of the outer ring 490 and the outside of the swaged inner ring 460. Swaging is complete when the outer ring reaches a roundness within the tolerance limits. Typically, the outer conductor 20 is trimmed, removing any exposed short ends of the layer of the titanium clad copper conductor that extend out from under the outer ring 490. The cable with the connector 400 installed is shown in FIG. 5.

It is to be understood that the foregoing description and specific embodiments are merely illustrative of the best mode of the invention and the principles thereof, and that various modifications and additions may be made to the invention by those skilled in the art, without departing from the spirit and scope of this invention, which is therefore understood to be limited only by the scope of the appended claims.

What is claimed is:

1. A conductive connector for a cable with a core strength member, an inner conductor, an outer conductor, and a cable jacket, wherein the cable can be circumferentially notched, removing a sectional length of jacket exposing an outermost layer of the inner conductor and removing a shorter sectional length of a center portion of the outermost layer, exposing one or more underlying layers of the inner conductor and a pair of flanking sectional lengths of the exposed outermost layer, said connector comprising:

a pair of intermediate halves of a longitudinally split open-ended cylinder comprised of a conductive metallic material, said split open-ended cylinder having a split-cylinder length substantially equal to the sectional length of the jacket, where each said intermediate half has a semi-cylindrical wall with a thicker center wall having a smaller center inside diameter and a width substantially equal to the shorter sectional length of the inner conductor, and a pair of flanking walls, where said pair of flanking walls bookend said center wall, and each said flanking wall has a flanking wall length and a flanking wall inside diameter that is larger than said inside diameter of said center wall, wherein said pair of intermediate halves are configured to be assembled on the cable to form said split open-ended cylinder so that the ends of said intermediate halves sealedly abut the jacket and said center wall fits inside the shorter sectional length and abuts the flanking sectional lengths of the exposed outermost layer of the inner conductor; and a cylindrical inner ring comprised of a conductive metallic material and having a pair of open ends, each said open end having a plurality of recessed inside circumferential grooves that are proximate to the open end, wherein said inner ring has a length sufficient to span beyond said intermediate halves such that said plurality of circumferential grooves on both said open ends of said inner ring overlap the cable jacket, and wherein said inner ring has an inside diameter substantially equal to the outside diameter of the cable so that said circumferential grooves are in contact with and emboss the jacket when said inner ring is placed over and swaged onto said intermediate halves.

2. The connector according to claim 1 further comprising:

a cylindrical outer ring comprised of a metallic material and having an inside diameter that is large enough to slide over the cable and an outer conductor distributed around said inner ring so that the outer conductor is overlaying most of said inner ring;

wherein, after said outer ring has been slid over the outer conductor and centered over said inner ring, said outer ring is configured to be swaged to anchor the outer conductor between said outer ring and said inner ring.

3. The connector according to claim 2, wherein said inner ring is comprised of a corrosion resistant material.

4. The connector according to claim 2, wherein said inner ring is comprised of titanium.

5. The connector according to claim 4, wherein said inner ring is plated in platinum.

6. The connector according to claim 2, wherein said intermediate halves are comprised of aluminum.

7. The connector according to claim 6, wherein said intermediate halves are plated in fin.

8. The connector according to claim 2, wherein said outer ring is comprised of a corrosion resistant metallic material.

9. The connector according to claim 2, wherein said outer ring is comprised of titanium.

10. The connector according to claim 1 further comprising;

an electrical joint compound, wherein said electrical joint compound is coated on exposed layers of the inner conductor, where said electrical joint compound facilitates conduction between the inner conductor and said pair of intermediate halves assembled on the cable.

11. The connector according to claim 1, wherein the depths of said plurality of recessed inside circumferential grooves are less than the thickness of the jacket so as to allow said inner ring to emboss and grip the jacket without piercing the jacket when said inner ring is swaged onto the cable.

12. The connector according to claim 2, wherein the depths of said plurality of recessed inside circumferential grooves are less than the thickness of the jacket so as to allow said inner ring to emboss and grip the jacket without piercing the jacket when said inner ring is swaged onto the cable.

13. A sealed, corrosion resistant cable having electrically connected inner and outer conductors, comprising:

an inner conductor having a circumferential notch cut into an outer layer thereof;

a jacket covering and environmentally sealing said inner conductor, said jacket having a circumferential notch cut therein thereby creating trimmed ends of said jacket, said notch being adjacent to and having a length that is longer than the length of said notch in said inner conductor;

a longitudinally split open-ended cylinder comprised of a conductive metallic material and having a thick center wall and thin flanking walls, said thick center wall filling said notch in said inner conductor and contacting said inner conductor, and said flanking walls filling said notch in said jacket and sealedly abutting the trimmed ends of said jacket;

a cylindrical inner ring having a pair of open ends and a length longer than the length of said notch in said jacket, each said open end having a plurality of recessed inside circumferential grooves that are proximate to the open ends of said inner ring, wherein said inner ring wraps around said longitudinally split cylinder and said jacket and is swaged so that said inner ring contacts said longitudinally split cylinder and said grooves are embossed into said jacket without piercing through said jacket;

an outer conductor wrapped around said jacket and said inner ring; and an open-ended, cylindrical outer ring wrapped around said outer conductor and said inner ring, said outer ring being swaged, thereby anchoring said outer conductor to said inner ring and creating an electrically conductive path between said outer and inner conductors through said longitudinally split cylinder and said inner ring.

14. The cable of claim 13, wherein said jacket is comprised of polytetrafluoroethylene (PTFE).

15. The cable of claim 13, further comprising a continuous strength member disposed within said inner conductor.

16. The cable of claim 15, wherein said inner conductor is comprised of a plurality of layers of aluminum wire.

17. The cable of claim 16, wherein said outer conductor is composed of a layer of titanium clad copper conductor wire.

18. The cable of claim 16, wherein said longitudinally split cylinder is comprised of aluminum and is plated in tin.

19. The cable of claim 18, wherein said inner ring is comprised of titanium and is plated in platinum.

20. The cable of claim 17, wherein said outer ring is comprised of titanium.

* * * * *